US008985067B2

(12) United States Patent
Demitroff et al.

(10) Patent No.: US 8,985,067 B2
(45) Date of Patent: Mar. 24, 2015

(54) HEAT PIPE ASSEMBLY IN AN ENGINE LUBRICATION SYSTEM

(75) Inventors: Danrich Henry Demitroff, Okemos, MI (US); Furqan Zafar Shaikh, Troy, MI (US); Donald Masch, White Lake, MI (US); Michael Levin, Ann Arbor, MI (US); James Patrick O'Neill, Milford, MI (US); Lawrence Marshall, Saint Clair Shores, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 591 days.

(21) Appl. No.: 13/421,689

(22) Filed: Mar. 15, 2012

(65) Prior Publication Data

US 2013/0239923 A1 Sep. 19, 2013

(51) Int. Cl.

| | |
|---|---|
| ***F02F 3/18*** | (2006.01) |
| ***F01M 5/00*** | (2006.01) |
| ***F01M 11/00*** | (2006.01) |

(52) U.S. Cl.

CPC ..... *F01M 5/002* (2013.01); *F01M 11/0004* (2013.01); *F01M 2011/0025* (2013.01)

USPC ..... 123/41.33; 123/196 AB

(58) Field of Classification Search

USPC ..... 123/41.33, 196 AB

See application file for complete search history.

(56) References Cited

U.S. PATENT DOCUMENTS

| | | | |
|---|---|---|---|
| 3,884,293 | A | 5/1975 | Pessolano et al. |
| 5,345,998 | A | 9/1994 | Itoh |
| 5,454,351 | A | 10/1995 | Cao et al. |
| 6,349,681 | B1 | 2/2002 | Li |
| 2008/0078288 | A1 | 4/2008 | Heidrich et al. |

FOREIGN PATENT DOCUMENTS

| | | | |
|---|---|---|---|
| GB | 2270375 | A | 3/1994 |
| JP | 2010121520 | A | 6/2010 |

*Primary Examiner* — Noah Kamen

(74) *Attorney, Agent, or Firm* — Julia Voutyras; Alleman Hall McCoy Russell & Tuttle LLP

(57) ABSTRACT

An engine lubrication system is provided. The engine lubrication system includes an oil pan housing a lubricant, an oil pump having a pick-up tube including an inlet submerged in the lubricant, and a heat pipe assembly including a fluidly sealed heat pipe coupled to the oil pan adjacent to the inlet of the pick-up tube.

18 Claims, 5 Drawing Sheets

HEAT PIPE ASSEMBLY IN AN ENGINE LUBRICATION SYSTEM

BACKGROUND/SUMMARY

Engines utilize lubrication systems to lubricate moving parts, improve sealing, inhibit corrosion, and cool a number of components in the engine. However, the oil in the lubrication system may overheat causing the oil viscosity to decrease and engine temperature to increase. As a result, engine operation may be degraded.

Therefore, engine cooling systems have been developed to cool the lubrication system as well as the cylinder block and/or cylinder head in an engine. Specifically, liquid to liquid oil coolers are utilized in engines to decrease the temperature of the oil as well as the combustion chambers in the engine. In some engines, to remove heat from both the engine and the oil, engine coolant is routed in series through the engine and subsequently through a liquid to liquid heat exchanger in the lubrication system or vice-versa and then routed to a radiator where heat is transferred to the surrounding environment. Parallel arrangements may also be used where engine cooling is directed in parallel through the lubrication system, then to the engine, and then to a radiator.

However, the Inventors have recognized several drawbacks with the aforementioned types of cooling systems. When engine coolant is routed in series through the engine and the lubrication system, a desired amount of engine cooling and/or oil cooling may not be achieved. Furthermore, when engine coolant is routed in parallel through the engine and oil, the size of the radiator is increased, thereby increasing the size and cost of the engine.

As such, in one approach an engine lubrication system is provided, where the system includes an oil pan housing a lubricant, an oil pump having a pick-up tube including an inlet submerged in the lubricant, and a heat pipe assembly including a fluidly sealed heat pipe coupled to the oil pan adjacent to the inlet of the pick-up tube.

In this way, heat may be removed from the oil in the oil pan via a passive heat pipe, with the heat removal pin-pointed to a location where such heat removal is most needed. As a result, the temperature of the oil entering the pick-up tube may be decreased, thereby reducing the likelihood of oil degradation and engine overheating.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

An engine lubrication system having a heat pipe assembly coupled to an oil pan is described herein. The heat pipe assembly includes a fluidly sealed heat pipe having a higher temperature end positioned in an oil pan enclosure adjacent to an inlet of an oil pump pick-up tube and a lower temperature end positioned vertically above the lower temperature end and external to the oil pan enclosure. In this way, the oil pan may be provided with a separate cooling system that is passive.

Figure 1:
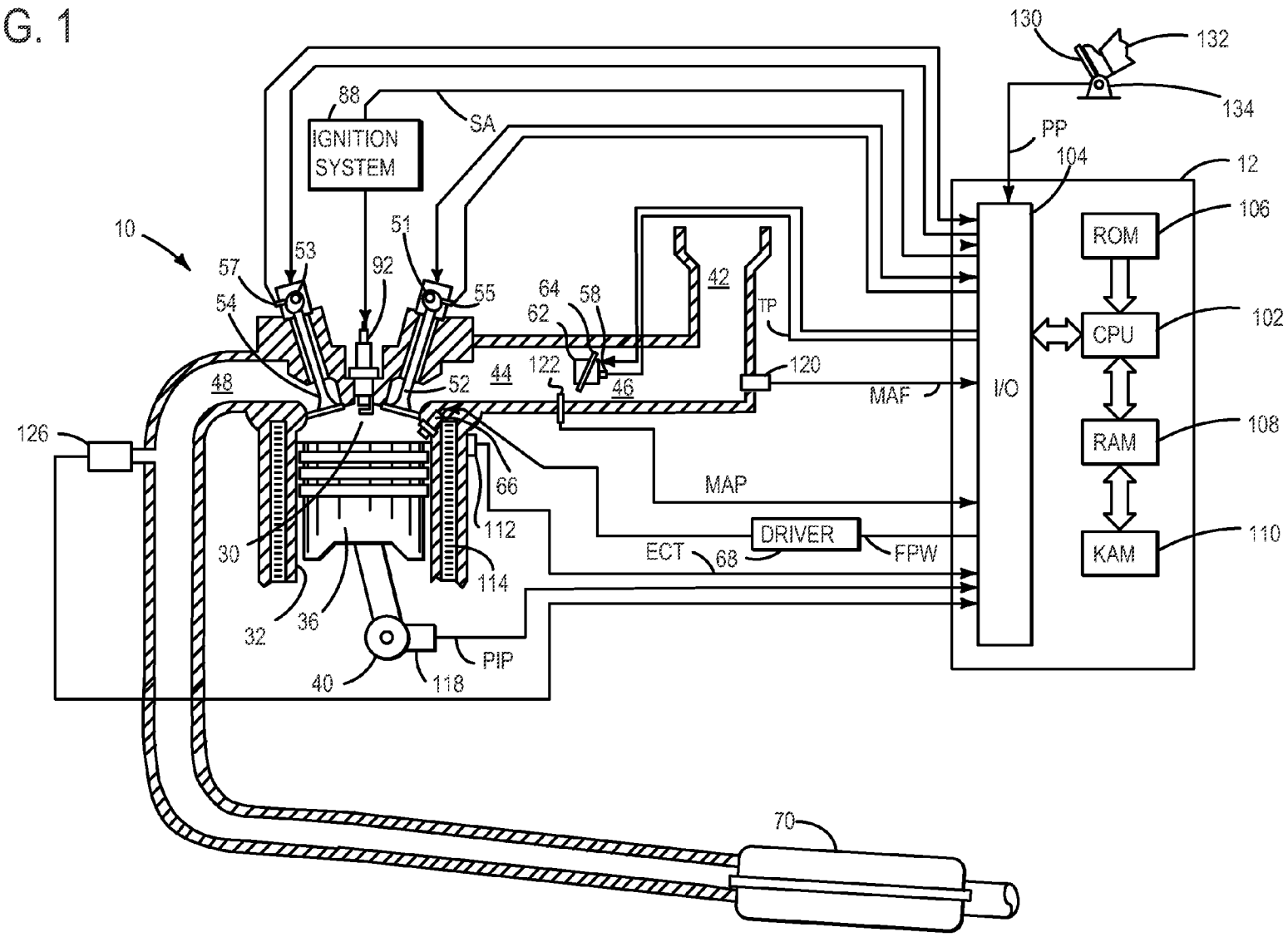
FIG. 1 shows a schematic depiction of an engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to a crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively or additionally, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Fuel injector 66 is shown positioned to inject fuel directly into combustion chamber 30, which is known to those skilled in the art as direct injection. Alternatively or additionally, fuel may be injected to an intake port, which is known to those skilled in the art as port injection. Fuel injector 66 delivers liquid fuel in proportion to the pulse width of signal FPW from controller 12. Fuel is delivered to fuel injector 66 by a fuel system (not shown) including a fuel tank, fuel pump, and fuel rail (not shown). Fuel injector 66 is supplied operating current from driver 68 which responds to controller 12. In addition, intake manifold 44 is shown communicating with optional electronic throttle 62 which adjusts a position of throttle plate 64 to control air flow from intake boost chamber 46. In other examples, the engine 10 may include a turbocharger having a compressor positioned in the intake system and a turbine positioned in the exhaust system. The turbine may be coupled to the compressor via a shaft. A high pressure, dual stage, fuel system may be used to generate higher fuel pressures at injectors 66.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; a knock sensor for determining ignition of end gases (not shown); a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

Figure 2:
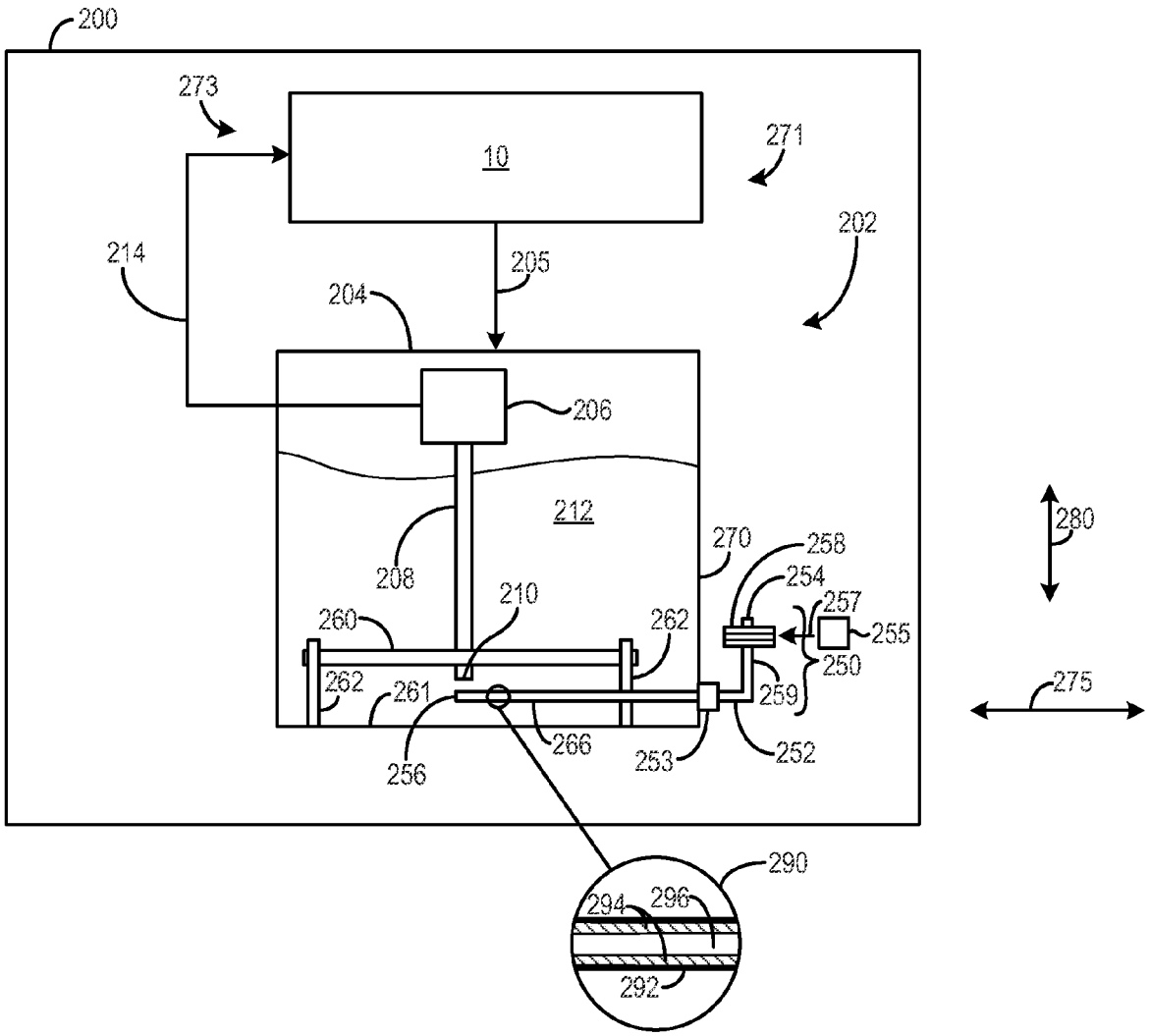
FIG. 2 shows a schematic depiction of a vehicle including an engine lubrication system.

FIG. 2 shows a vehicle 200 including the engine 10. An engine lubrication system 202 is provided in the vehicle 200. The engine lubrication system 202 includes an oil pan 204 configured to receive oil or other suitable lubricant from the engine 10 during engine operation. Arrow 205 denotes the transfer of oil from the engine 10 to the oil pan 204. The oil pan 204 is shown spaced away from the engine 10, however it will be appreciated that the oil pan 204 may be directly coupled to an oil pan engaging surface on a bottom side of the engine 10. An oil pump 206 is also included in the engine lubrication system 202. The oil pump 206 is shown positioned in the oil pan 204, however in other examples the oil pump 206 may be positioned outside of the oil pan 204. The oil pump 206 includes a pick-up tube 208 having an inlet 210 positioned in the oil pan 204. The inlet 210 is submerged in oil 212 or other suitable lubricant. At least one oil conduit, denoted via arrow 214, may fluidly couple the oil pump 206 to the engine 10. In this way, oil may be supplied to the engine 10 via the oil pump 206. The oil conduit 214 is included in the engine lubrication system 202. The oil conduit 214 is configured to provide oil to components in the engine 10 such as the piston 36 shown in FIG. 1, the crankshaft 40 shown in FIG. 1, etc.

Figure 3:
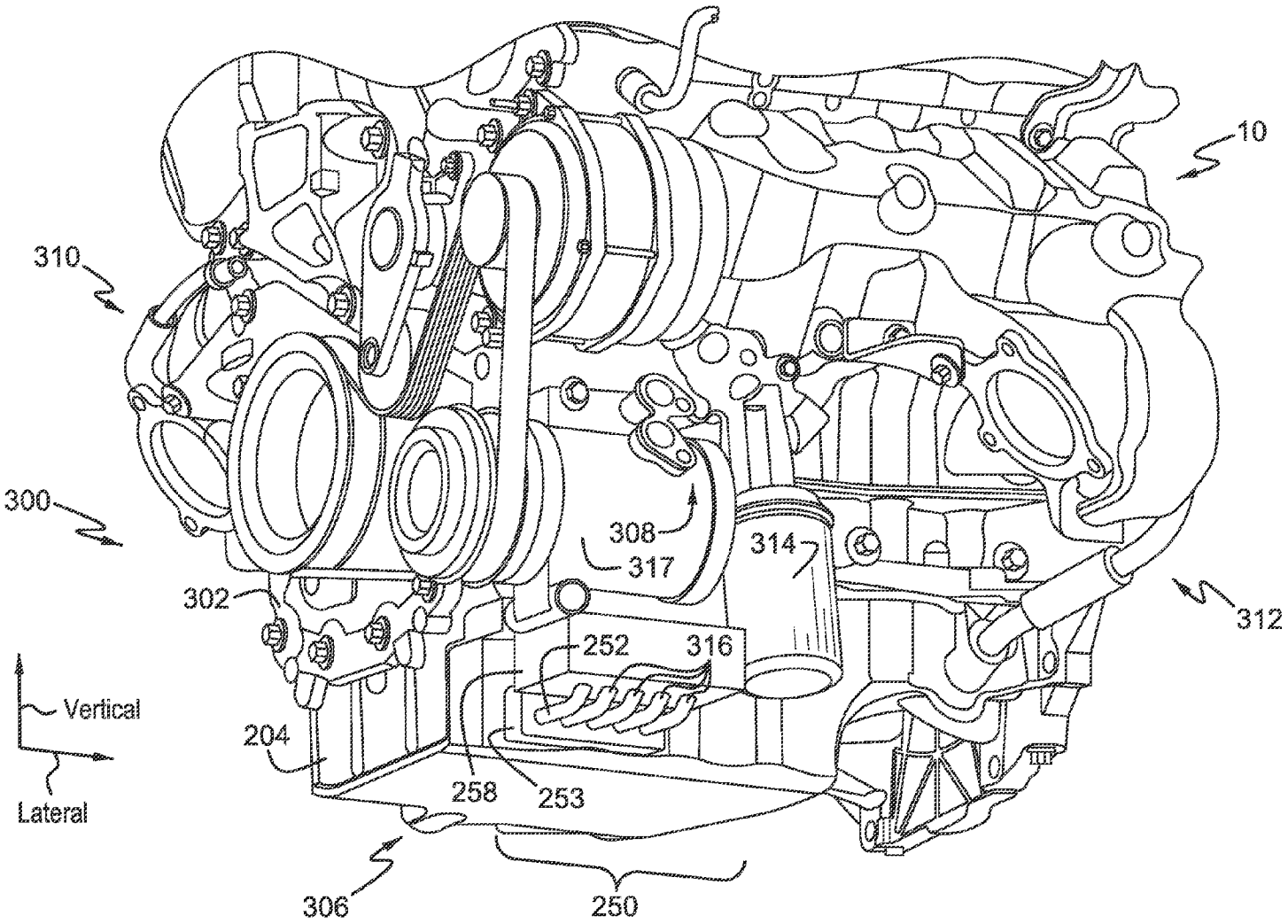
FIG. 3 shows an illustration drawn to scale of an oil pan and a heat pipe assembly in the engine lubrication system shown in FIG. 1.
Figure 4:
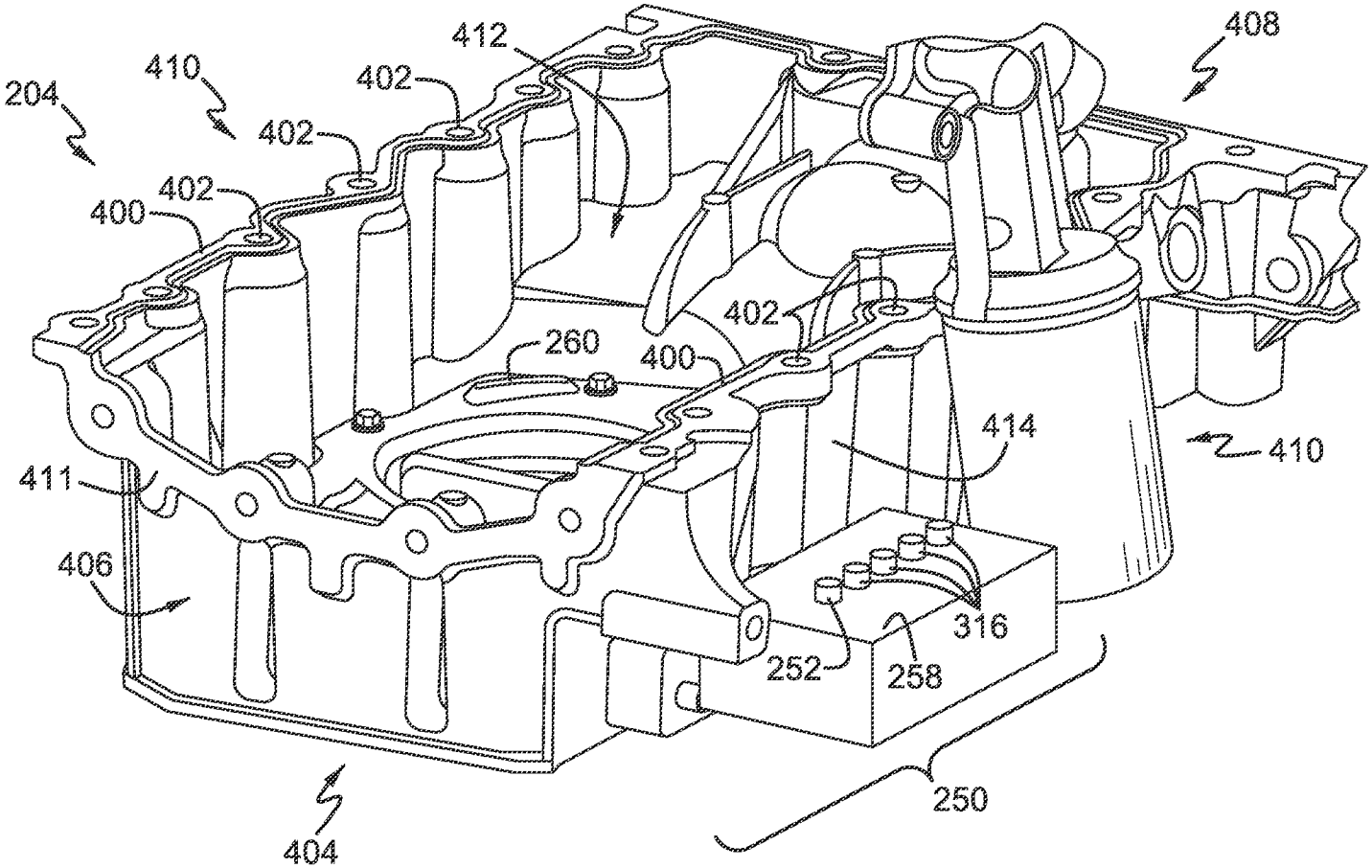
FIG. 4 shows another view, also to scale, of a portion of the engine lubrication system shown in FIG. 2.

A heat pipe assembly 250 may also be included in the engine lubrication system 202. The heat pipe assembly 250 may be coupled to the oil pan 204 and is configured to provide passive cooling to the oil enclosed in the oil pan 204. A more detailed illustration of the heat pipe assembly 250 is shown in FIGS. 3 and 4 and described in greater detail herein.

The heat pipe assembly 250 includes at least one heat pipe 252. It will be appreciated that heat pipe 252 may be included in a plurality of heat pipes. The heat pipe 252 is configured to transfer heat from the oil to the surrounding environment. In this way, the temperature of the oil in the oil pan 204 may be reduced. As a result, the likelihood of the oil increasing above an undesired temperature during engine operation may be reduced.

An expanded view of the heat pipe 252 is shown at 290. The heat pipe 252 includes a housing 292 enclosing a wicking material 294. Specifically, the wicking material 294 may be coupled to the housing 292. The wicking material 294 may extend down the entire length of the heat pipe 252. A working fluid may be enclosed within the housing 292. The working fluid in the heat pipe 252 may comprise water, ammonia, ethanol, and/or other suitable fluids. The type of working fluid may be selected based on a desired working temperature range of the heat pipe 252. Other characteristics of the heat pipe 252 may be altered to adjust the working temperature range such as the thickness of the size and/or geometry of the heat pipe and/or the types of materials used to construct the heat pipe (e.g., housing material and wicking material). The wicking material 294 is configured to draw the working fluid in liquid form from a first end 254 of the heat pipe 252 to a second end 256 of the heat pipe. The first end 254 may be referred to as a lower temperature end and the second end 256 may be referred to as a higher temperature end. The wicking material 294 may define a boundary of a vapor cavity 296. The vapor cavity 296 may extend from the first end 254 to the second end 256. Vapor may be generated in the second end 256 of the heat pipe 252 or in the section of the heat pipe 252 submerged in the oil 212 through the transfer of heat from the oil 212 to the working fluid of the heat pipe 252. Subsequently, the vapor generated in the second end 256 may flow towards the first end 254 of the heat pipe 252 through the vapor cavity 296. At the first end 254 or in the section of the heat pipe 252 external to the oil pan 204 vapor in the vapor cavity 296 may condense through the transfer of heat from the housing 292 to the external environment. The condensed vapor may then flow through the wicking material 294 back towards to the first end 254. In this way, heat may be passively transferred from the oil 212 to the external environment via the heat pipe 252.

The housing 292 may comprise copper, nickel-copper alloys, and/or titanium. The wicking material 294 may include mesh screens, axial grooves, sintered metal powders, sintered metal powder grooves, and/or sintered slabs. The heat pipe 252 is coupled to the oil pan 204 via a mounting component 253. However, other suitable attachment techniques have been contemplated.

The heat pipe 252 extends through a wall 270 of the oil pan 204. The wall 270 may be on a lateral side of the engine 10. Specifically in some examples, the wall 270 may be on an exhaust side 271 of the engine 10. The exhaust side of the engine 10 may include an exhaust manifold in fluidic communication with exhaust valves in the engine. In such an example, the other lateral side of the engine 10 may be referred to as an intake side 273 of the engine. It will be appreciated that in other examples, the cylinders in the engine 10 may have a different configuration and therefore the exhaust side 271 and the intake side 273 may be lateral sides. The first end 254 is positioned external to the oil pan 204 and the second end 256 is positioned in the oil pan 204 and submerged in the oil 212. Specifically, the first end 254 may be submerged in oil when the engine is performing combustion as well as not performing combustion. The first end 254 is positioned vertically above the second end 256. A vertical axis 280 is provided for reference. However, it will be appreciated that other oil pan orientations have been contemplated.

The heat pipe 252 is fluidly sealed. That is to say that the gas and/or liquid enclosed within the heat pipe 252 may not flow into the surrounding environment. A plurality of cooling plates 258 or fins may be coupled a section of the heat pipe external to the oil pan 204. The cooling plates 258 may be spaced apart to enable air to flow between the plates, thereby increasing the amount of heat transferred from the plates to the surrounding air. In some examples, one or more fans 255, such as electric fans, configured to direct airflow at the cooling plates 258 may be included in the vehicle 200. The fans 255 may increase air circulation around and between the plates to increase heat transfer from the plates to the surrounding air. Arrow 257 denotes the flow of air from the fans 255 to the cooling plates 258 The cooling plates 258 are positioned adjacent to and at the first end 254 of the heat pipe 252, where the plates are contiguous with an exterior wall of the heat pipe at first end 254. The cooling plates 258 are configured to transfer heat from the heat pipe 252 to the surrounding environment. Additionally, the heat pipe 252 includes a section 259 substantially perpendicular to a section 266 of the heat pipe 252 positioned in the oil pan 204. Section 259 extends in a vertical direction. However, other heat pipe geometries may be utilized in other examples.

The engine lubrication system 202 may also include a windage tray 260 positioned in the oil pan 204 adjacent to and slightly above inlet 210 of the pick-up tube 208. The second end 256 of the heat pipe 252 is positioned vertically under the windage tray 260. In one example, the windage tray 260 is contiguous with the pick-up tube 208. The windage tray 260 is configured to keep the oil 212 near the inlet 210 during vehicle travel. The windage tray 260 is coupled to the oil pan 204 via attachment apparatuses 262 such as bolts, screws, etc.

The section 266 of the heat pipe 252 and specifically the second end 256 is positioned vertically below the windage tray 260. Furthermore, the second end 256 is positioned vertically below the inlet 210 and adjacent to the pick-up tube 208 near the inlet 210. Additionally, the second end 256 is adjacent to a bottom surface 261 of the oil pan 204. Thus, no components are positioned between the second end 256 and the bottom surface 261. Further, in one embodiment, there are no other component between an external wall of heat pipe 252 and the inlet 210, other than potentially engine oil. The section 266 is shown laterally oriented. A lateral axis 275 has been provided for reference. However, other heat pipe arrangements have been contemplated. When heat pipe 252 is positioned below the windage tray 260, the heat pipe 252 may be submerged in the oil for a greater amount of time during vehicle travel. As a result, a greater amount of heat may be transferred to the heat pipe 252 from the oil 212.

FIG. 3 shows an illustration of an example engine 10. The oil pan 204 may be coupled to a cylinder block included in the engine 10. The cylinder block may be coupled to a cylinder head forming the combustion chamber 30, shown in FIG. 1. The oil pan 204 is positioned vertically below the cylinder block. In this way, gravity may be used to collect oil in the oil pan 204. The engine 10 includes a front side 300 including a front engine cover 302. The engine 10 further includes a bottom side 306, a first lateral side 308, a second lateral side 310, and a rear side 312. The rear side 312 may be coupled to a transmission in the vehicle 200.

An oil filter 314 is also shown. The oil filter 314 is adjacent to the heat pipe assembly 250, in that an external wall of the filter is positioned adjacent to edges of the cooling plates 258. However, other locations have been contemplated. The figure also illustrates heat pipe 252. As previously discussed, the heat pipe assembly 250 may include additional heat pipes 316. In the depicted example, the heat pipe 252 and the heat pipes 316 are substantially identical in shape, material and size. Thus the heat pipes 316 and heat pipe 252 are substantially parallel to one another. However, in other examples the shape, material, and/or size of the heat pipe may vary between heat pipes.

The mounting component 253 is also shown in FIG. 3. The mounting component 253 is coupled to an external surface of the oil pan 204. The mounting component 253 is configured to receive the heat pipe 252 and the heat pipes 316 and fix the relative position of the heat pipes with regard to the oil pan 204.

The cooling plates 258 are also shown in FIG. 3. As shown, the cooling plates 258 are locate near the first end 254 of the heat pipe 252 shown in FIG. 2. As shown the cooling plates 258 are positioned adjacent to a belt driver component 317, such as an air conditioning compressor, power steering pump, alternator, etc. The cooling plates 258 transfer heat from the heat pipes to the ambient air surrounding the engine 10. In this way, heat may be dissipated into the surrounding environment. The cooling plates 258 enable a greater amount of heat to be transferred from the oil to the external environment by increasing surface area. In this way, engine operation may be improved. The cooling plates 258 are horizontally aligned in the depicted example. However, in other examples the cooling plates 258 may have an alternate orientation. A lateral axis and a vertical axis are provided for reference. The cooling plates 258 may comprise a metal such as aluminum, steel, etc.

FIG. 4 shows an illustration of the oil pan 204 and the heat pipe assembly 250 shown in FIG. 3. The oil pan 204 includes a cylinder block engaging surface 400 configured to attach to the cylinder block shown in FIG. 2. The cylinder block engaging surface 400 includes openings 402 configured to receive attachment apparatuses for attaching the oil pan 204 to a cylinder block included in the engine 10 shown in FIG. 3. The oil pan includes a bottom side 404, a front side 406, a rear side 408, and two lateral sides 410 defining the boundary of an oil pan enclosure 412. The front side 406 includes a front engine cover engaging surface 411 configured to attach to the front engine cover 302, shown in FIG. 3. It will be appreciated that the oil pan enclosure 412 may receive oil during operation of the engine 10 shown in FIGS. 1 and 2. The windage tray 260 is also shown in FIG. 4. Heat pipe 252 and heat pipes 316 are also shown in FIG. 4. The heat pipes (252 and 316) extend through a lateral side wall 414 of the oil pan 204.

Figure 5:
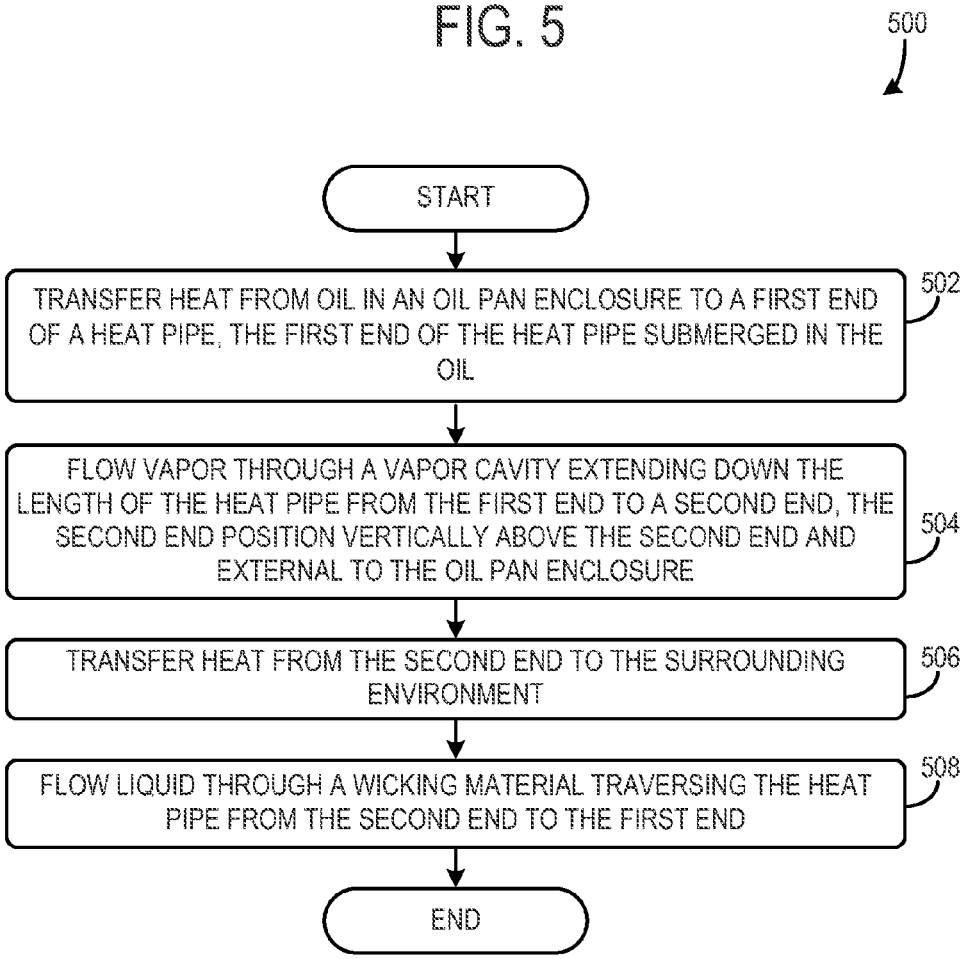
FIG. 5 shows a method for operation of an engine lubrication system.

FIG. 5 shows a method 500 for operation of an engine lubrication system. Method 500 may be implemented via the engine lubrication system described above with regard to FIGS. 2-4 or may be implemented via another suitable engine lubrication system.

At 502 the method includes transferring heat from oil in an oil pan enclosure to a first end of a heat pipe, the first end of the heat pipe submerged in the oil. The first end of the heat pipe may be positioned vertically below a windage tray in the oil pan enclosure and/or adjacent to an inlet of a pick-up tube of an oil pump.

At 504 the method includes flowing vapor through a vapor cavity extending down the length of the heat pipe from the first end to a second end, the second end position vertically above the second end and external to the oil pan enclosure.

At 506 the method includes transferring heat from the second end to the surrounding environment and at 508 the method includes flowing liquid through a wicking material traversing the heat pipe from the second end to the first end.

This concludes the description. The reading of it by those skilled in the art would bring to mind many alterations and modifications without departing from the spirit and the scope of the description. For example, single cylinder, I2, I3, I4, I5, V6, V8, V10, V12 and V16 engines operating in natural gas, gasoline, diesel, or alternative fuel configurations could use the present description to advantage.

The invention claimed is:

1. An engine lubrication system comprising:

an oil pan housing a lubricant;

an oil pump having a pick-up tube including an inlet submerged in the lubricant; and a heat pipe assembly including a fluidly sealed heat pipe coupled to the oil pan adjacent to the inlet of the pick-up tube.

2. The engine lubrication system of claim 1, where the heat pipe assembly is positioned on an exhaust side of the oil pan.

3. The engine lubrication system of claim 1, where the heat pipe assembly includes a heat pipe having a housing enclosing a wicking material and a vapor cavity.

4. The engine lubrication system of claim 3, where the housing is fluidly sealed.

5. The engine lubrication system of claim 3, where an end of the heat pipe is positioned under a tray in the oil pan.

6. The engine lubrication system of claim 3, where the heat pipe extends in a vertical direction.

7. The engine lubrication system of claim 1, where the heat pipe is submerged in the lubricant.

8. The engine lubrication system of claim 1, where the heat pipe extends through a lateral wall of the oil pan.

9. The engine lubrication system of claim 1, where an end of the heat pipe is adjacent to a bottom surface of the oil pan.

10. The engine lubrication system of claim 1, where the heat pipe includes a lower temperature end external to the oil pan and a higher temperature end positioned within the oil pan and submerged in the lubricant.

11. The engine lubrication system of claim 1, where the heat pipe assembly includes a cooling plate coupled to the lower temperature end.

12. An engine lubrication system comprising:

an oil pan housing a lubricant;

an oil pump having a pick-up tube including an inlet submerged in the lubricant; and a heat pipe assembly including a plurality fluidly sealed heat pipes coupled to the oil pan, each heat pipe having a higher temperature end positioned in an oil pan enclosure adjacent to the inlet of the pick-up tube and submerged in the lubricant and a lower temperature end positioned external to the oil pan.

13. The engine lubrication system of claim 12, wherein the heat pipes are substantially parallel to one another.

14. The engine lubrication system of claim 12, where the heat pipe assembly further includes a plurality of cooling plates coupled to the plurality of heat pipes.

15. The engine lubrication system of claim 12, further comprising a windage tray positioned vertically above the higher temperature end.

16. The engine lubrication system of claim 12, where the plurality of heat pipes each include a section that is laterally aligned and a second that is vertically aligned and perpendicular to the laterally aligned section.

17. The engine lubrication system of claim 12, where the heat pipe extend through a lateral wall of the oil pan.

18. An engine lubrication system comprising:

an oil pan housing a lubricant;

an oil pump having a pick-up tube including an inlet submerged in the lubricant;

a heat pipe assembly including a plurality fluidly sealed heat pipes coupled to the oil pan each heat pipe having a higher temperature end positioned in an oil pan enclosure adjacent to the inlet of the pick-up tube and submerged in the lubricant and a lower temperature end positioned external to the oil pan; and a windage tray positioned vertically above the higher temperature end.

* * * * *